US007131744B2

(12) United States Patent
Lee

(10) Patent No.: US 7,131,744 B2
(45) Date of Patent: Nov. 7, 2006

(54) SHINING COSTUME JEWELRY

(76) Inventor: Ching-Hui Lee, No. 13, Kangtzuwei, Madou Township, Tainan County (TW)

( * ) Notice: Subject to any disclaimer, the term of this patent is extended or adjusted under 35 U.S.C. 154(b) by 85 days.

(21) Appl. No.: 11/052,925

(22) Filed: Feb. 9, 2005

(65) Prior Publication Data

US 2006/0176679 A1 Aug. 10, 2006

(51) Int. Cl.
*F21V 33/00* (2006.01)

(52) U.S. Cl. ..... 362/104; 362/208; 362/205; 362/206

(58) Field of Classification Search ..... 362/103, 362/104, 105, 106, 108, 200, 202, 205, 206, 362/207, 208, 806; 63/3, 3.1
See application file for complete search history.

(56) References Cited

U.S. PATENT DOCUMENTS 5,927,842 A * 7/1999 Preisler ..... 362/103
6,017,140 A * 1/2000 Chou ..... 362/475
6,773,133 B1 * 8/2004 Lee ..... 362/121
6,923,550 B1 * 8/2005 Lee ..... 362/191
7,021,783 B1 * 4/2006 Quittner ..... 362/103
7,048,405 B1 * 5/2006 Lee ..... 362/121

* cited by examiner

*Primary Examiner*—Thomas M. Sember
(74) *Attorney, Agent, or Firm*—Rosenberg, Klein & Lee

(57) ABSTRACT

A piece of costume jewelry includes a circuit board, a battery holder, a button, and a conducting plate. The circuit board has light emitting diodes thereon and an IC member for controlling the light emitting diodes. A transparent glue covers the light emitting diodes and copper foils are located on a rear side of the circuit board. The battery holder is secured on the rear side of the circuit board while the batteries are held in the battery holder. The conducting plate is fitted to the battery holder to touch rear ends of the batteries. The conducting plate has a fitting hole and the battery holder has a locating protrusion passed through the fitting hole. The batteries and the button touch the copper foils of the circuit board respectively, and the IC member can be activated to make the light emitting diodes shine by means of pressing the button.

11 Claims, 7 Drawing Sheets

SHINING COSTUME JEWELRY

BACKGROUND OF THE INVENTION

1. Field of the Invention

The present invention relates to a piece of battery-powered shining costume jewelry, more particularly one, which is structured in such a way as to allow the user to change the batteries with ease.

2. Brief Description of the Prior Art

Jewelries are available in a wide variety of designs, and people have a lot of choices when they are searching for a piece of jewelry to match their clothing and make them look more attractive. And, there is always a great demand for new design jewelries, and there are people who like to buy and use fancy articles.

SUMMARY OF THE INVENTION

It is a main object of the invention to provide a piece of shining costume jewelry, which is powered by batteries, and which is structured in such a way as to allow the user to change the batteries with ease.

The jewelry of the invention includes a circuit board, a battery holder, a button, and a conducting plate. The circuit board has light emitting diodes thereon, an IC member for controlling the light emitting diodes, transparent glue covering the light emitting diodes, and copper foils on a rear side. The battery holder is secured on the rear side of the circuit board, and it has a locating protrusion while batteries are held in the battery holder. The conducting plate is fitted to the battery holder to touch rear ends of the batteries, and it has a fitting hole, through which the locating protrusion of the battery holder is passed. The batteries and the button touch the copper foils of the circuit board respectively, and the IC member can be activated to make the light emitting diodes shine by means of pressing the button against the corresponding copper foil.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
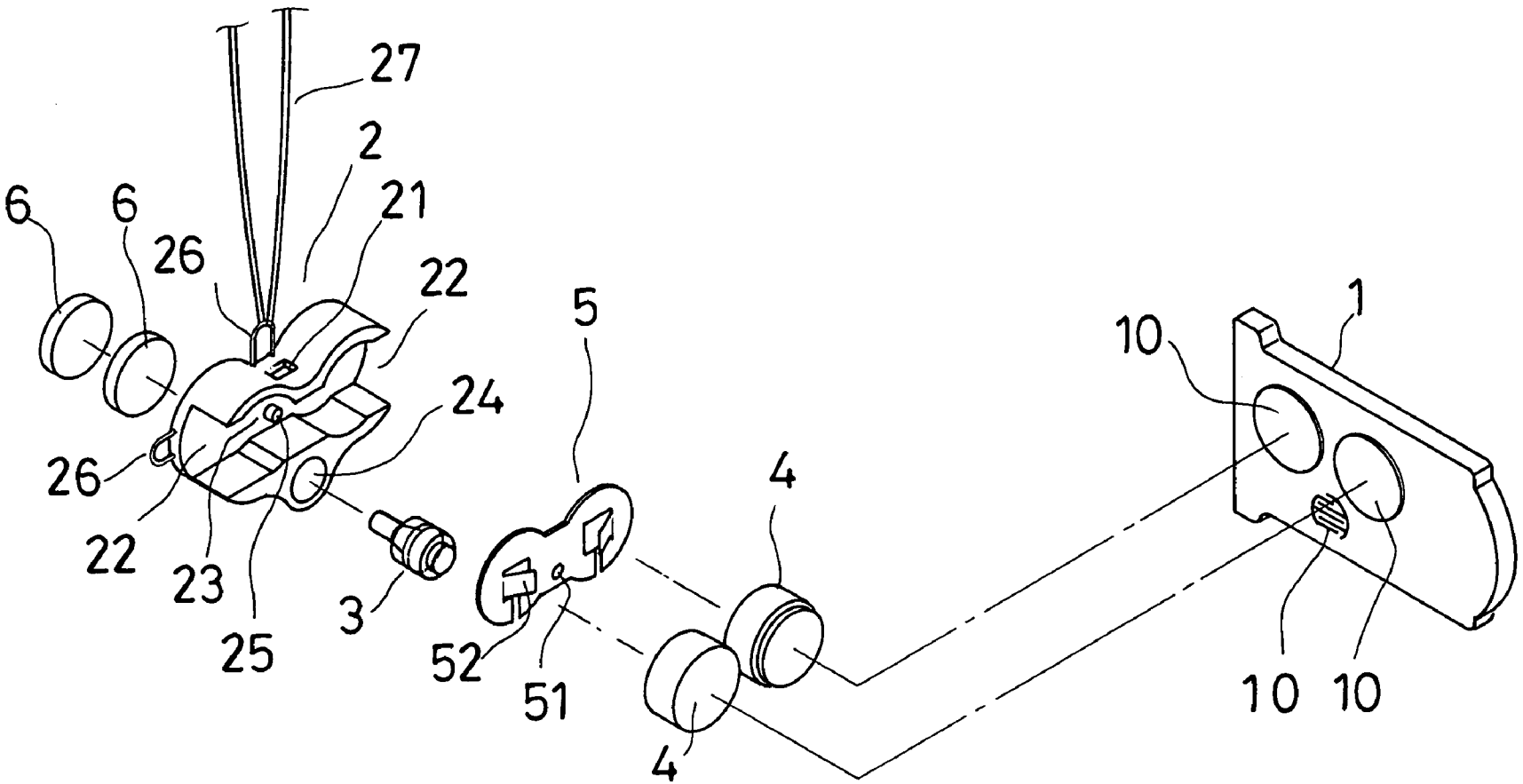
FIG. 1 is an exploded view of the first preferred embodiment of a piece of shining costume jewelry in the present invention.
Figure 2:
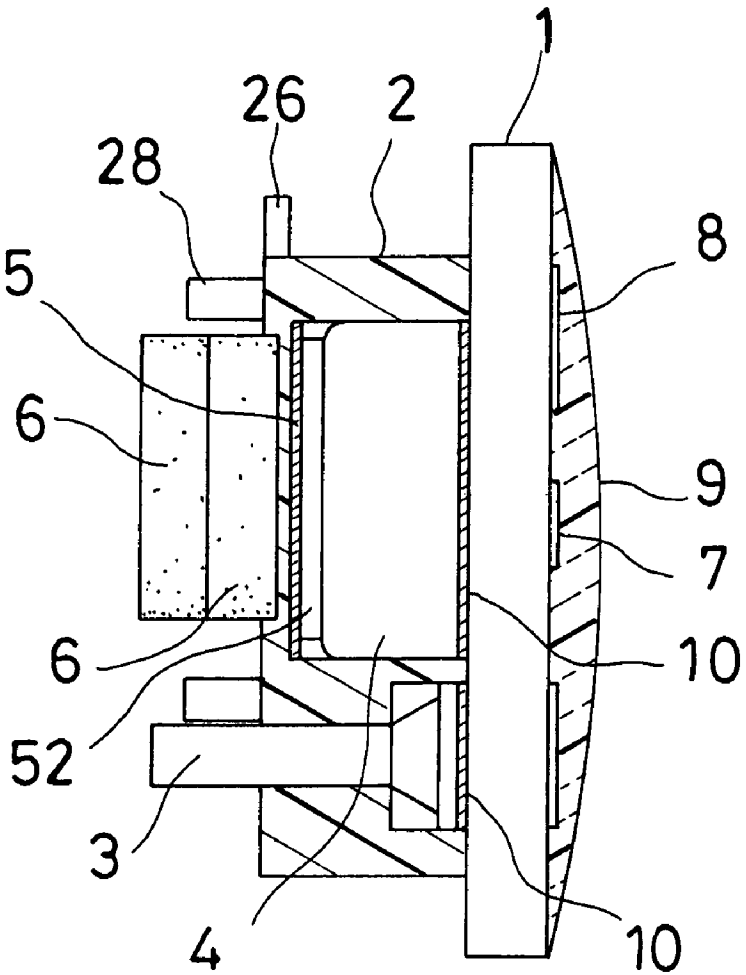
FIG. 2 is a side view of the first preferred embodiment.

Referring to FIGS. 1 and 2, a first preferred embodiment of a piece of shining costume jewelry includes a circuit board 1, a battery holder 2, a button 3, two batteries 4, and a conducting plate 5.

The circuit board 1 has several light emitting diodes 8 on a front side thereof, an IC member 7 for controlling the light emitting diodes 8, and three copper foils 10 on a rear side thereof. The light emitting diodes 8 are made in various colors, and arranged to form a design. Transparent glue 9 is applied over the circuit board 1 to cover the IC member 7 and the light emitting diodes 8.

The battery holder 2 is secured on a rear side of the circuit board 1. The battery holder 2 has a holding room 23 right behind first and second ones of the copper foils 10 of the circuit board 1, a small through hole 21 on a middle of an upper portion thereof, big through holes 22 at left and right ends thereof, a through locating hole 24 on a lower portion thereof, which is under the holding room 23, and faces a third one of the copper foils 10 of the circuit board 1; the small through hole 21 and the big holes 22 communicate with the holding room 23. The battery holder 2 further has a locating protrusion 25 in the holding room 23, a recess 20 on a rear side thereof, and two hanging rings 26 respectively on the top and the right end thereof while a lace 27 is connected to one of the hanging rings 26; thus, a person is allowed to hang the jewelry around his/her neck.

The conducting plate 5 is shaped like a section of dumbbell, and it is held in a rear end of the holding room 23 of the battery holder 2. The conducting plate 5 further has two elastic plate portions 52 projecting forwards, and a fitting hole 51, through which the locating protrusion 25 of the battery holder 2 is passed.

The two batteries 4 are passed through the left and the right big holes 22 of the battery holder 2 respectively and into the holding room 23 of the battery holder 2; thus, the batteries 4 are sandwiched between the conducting plate 5 and the circuit board 1 with front sides thereof respectively touching the first and the second copper foils 10, and with rear sides thereof respectively touching the forwards-projecting elastic plate portions 52 of the conducting plate 5. To remove the batteries 4 from the battery holder 2, first one passes a tool through the small through hole 21 of the battery holder 2 and into between the batteries 4, and then he pushes the batteries 4 outside by means of the tool.

The button 3 is passed through the locating hole 24 of the battery holder 2 to face the third copper foil 10 of the circuit board 1. Furthermore, two joined magnets 6 are fitted on the recess 20 of the battery holder 2 and firmly stuck in position; thus, the jewelry can be fastened on one person's clothes by means of the magnetic force of the magnets 6 instead.

Figure 3:
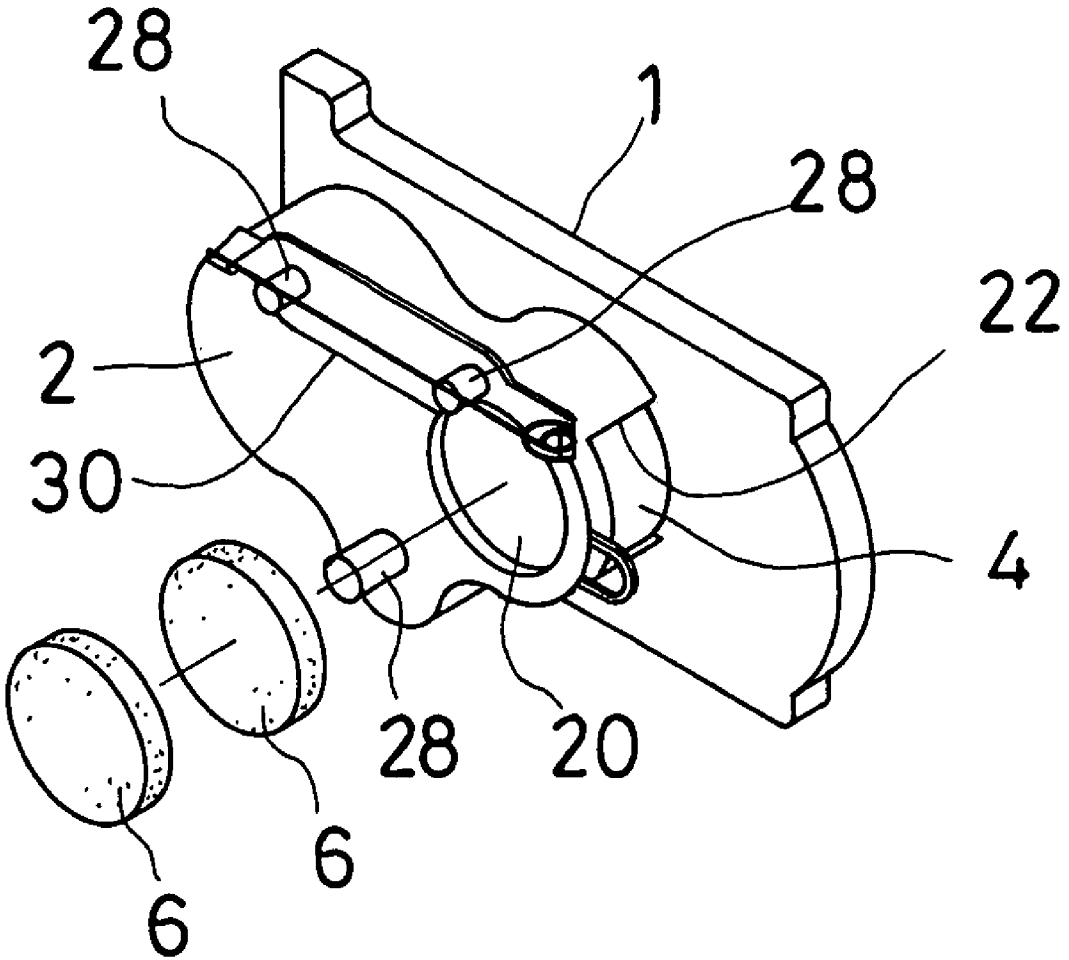
FIG. 3 is an exploded view of the second preferred embodiment of a piece of shining costume jewelry in the present invention.

Referring to FIG. 3, a rear perspective view of the second preferred embodiment of the invention, the battery holder 2 further has three posts 28 on the rear side thereof, and a safety pin 30 is stuck to the posts 28 by means of glue. Thus, the jewelry can be fastened on one person's clothes by means of the safety pin 30.

The IC member 7 can be activated by means of pressing the button 3 against the third copper foil 10 of the circuit board 1. And, when activated, the IC member 7 will make the light emitting diodes 8 shine in one of several different manners; the IC member 7 will change the way to control the light emitting diodes 8 each and every time the button 7 is pressed.

Figure 4:
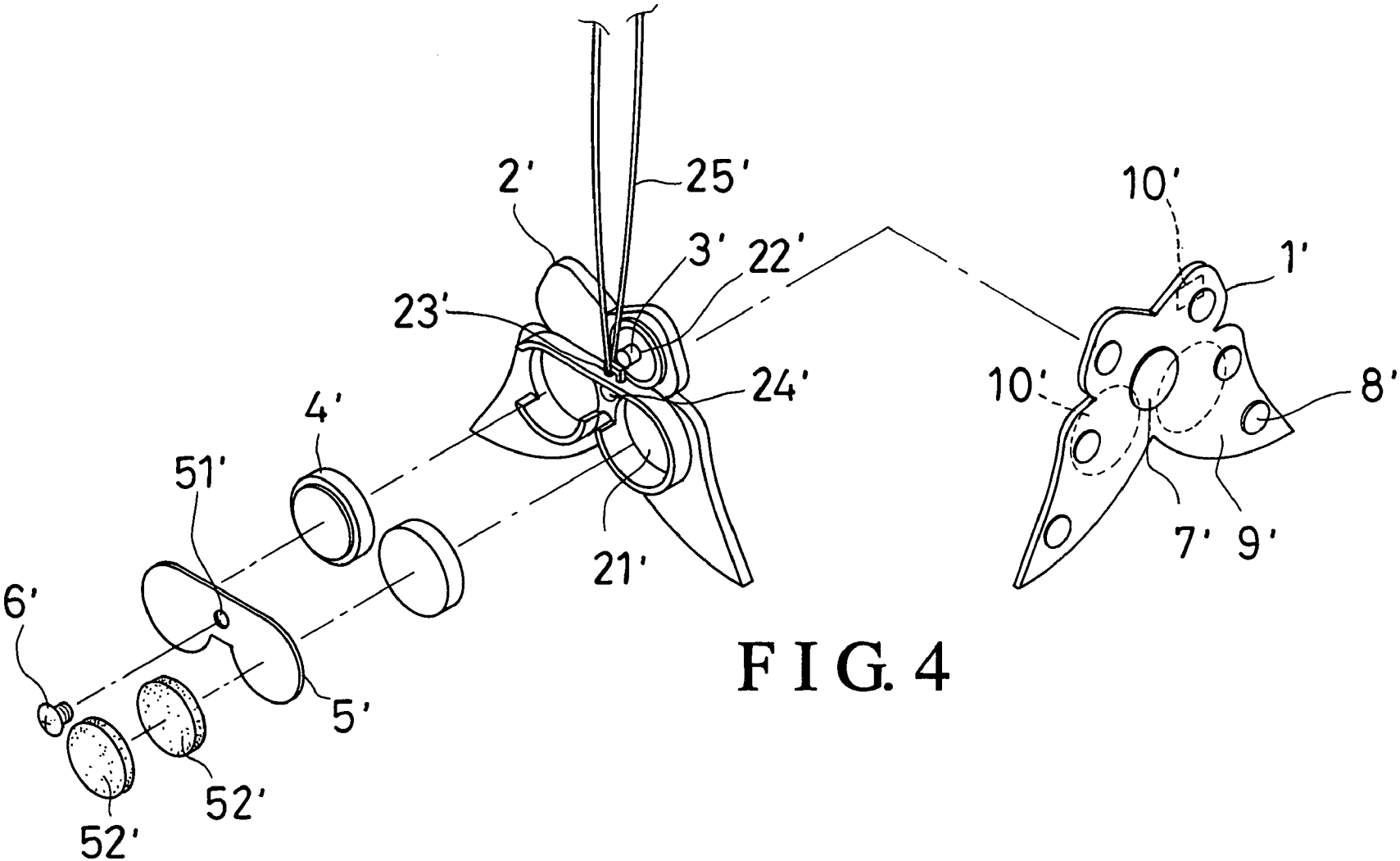
FIG. 4 is an exploded view of the third preferred embodiment of a piece of shining costume jewelry in the present invention.
Figure 5:
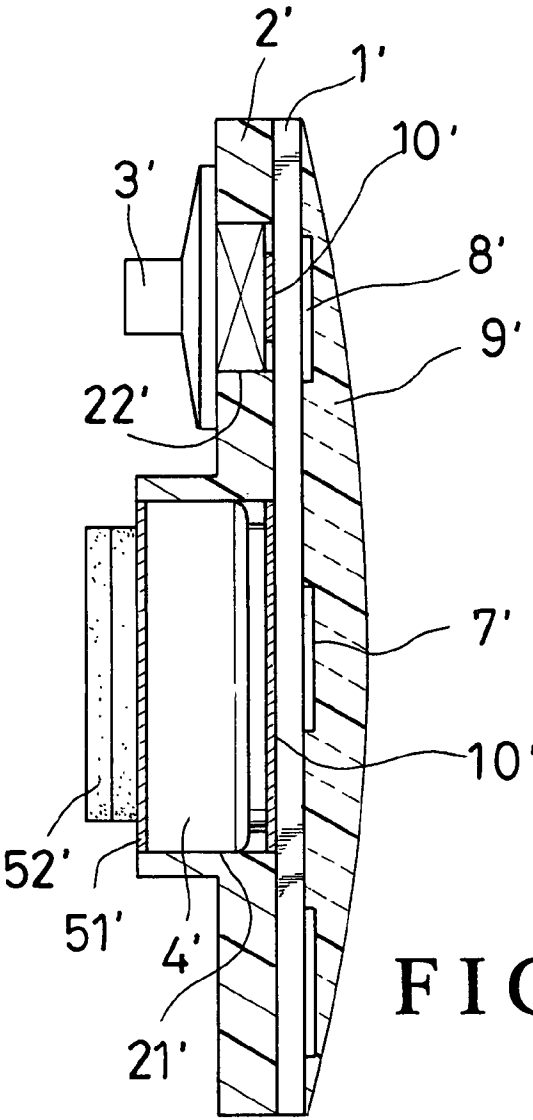
FIG. 5 is a side view of the third embodiment.

Referring to FIGS. 4 and 5, the third preferred embodiment of the invention includes a circuit board 1', a battery holder 2', a button 3', two batteries 4', and a conducting plate 5'.

The circuit board 1' has light emitting diodes 8', an IC member 7', and three copper foils 10', and transparent glue 9' is applied over the front side of the circuit board 1.

The battery holder 2' is secured on a rear side of the circuit board 1'. The battery holder 2' has a different shape from the last battery holder 2, having a holding room 21' facing first and second ones of the copper foils 10' of the circuit board 1', a rear opening at a rear end of the holding room 21', a hanging hook 23' arranged above the holding room 21', a screw hole 24', and a locating hole 22', which faces a third one of the copper foils 10. And, a lace 27 is connected to the hanging hook 23'. The batteries 4' are held in the holding room 21' of the battery holder 2'.

The conducting plate 5' has a screw hole 51', and it is secured over the rear opening of the battery holder 2' by means of a screw 6', which is passed through both the screw holes 51' and 24'; thus, the batteries 4' are sandwiched between the circuit board 10' and the conducting plate 5', touching the conducting plate 5' at rear ends thereof, and touching the first and the second copper foils 10' at front ends respectively. Therefore, one person is allowed to change the batteries 4' after removing the screw 6' and separating the conducting plate 5' from the battery holder 2'. The button 3' is passed through the locating hole 22' of the battery holder 2' to face the third copper foil 10' of the circuit board 1' so that the IC member 7' will be activated by means of pressing the button 3'. And, two joined magnets 52' are firmly stuck on a rear side of the conducting plate 5' while a safety pin (not shown) is secured on the rear side of the battery holder 2'. Thus, the third embodiment has the same function, and can be used in the same way as the last two embodiments.

Figure 6:
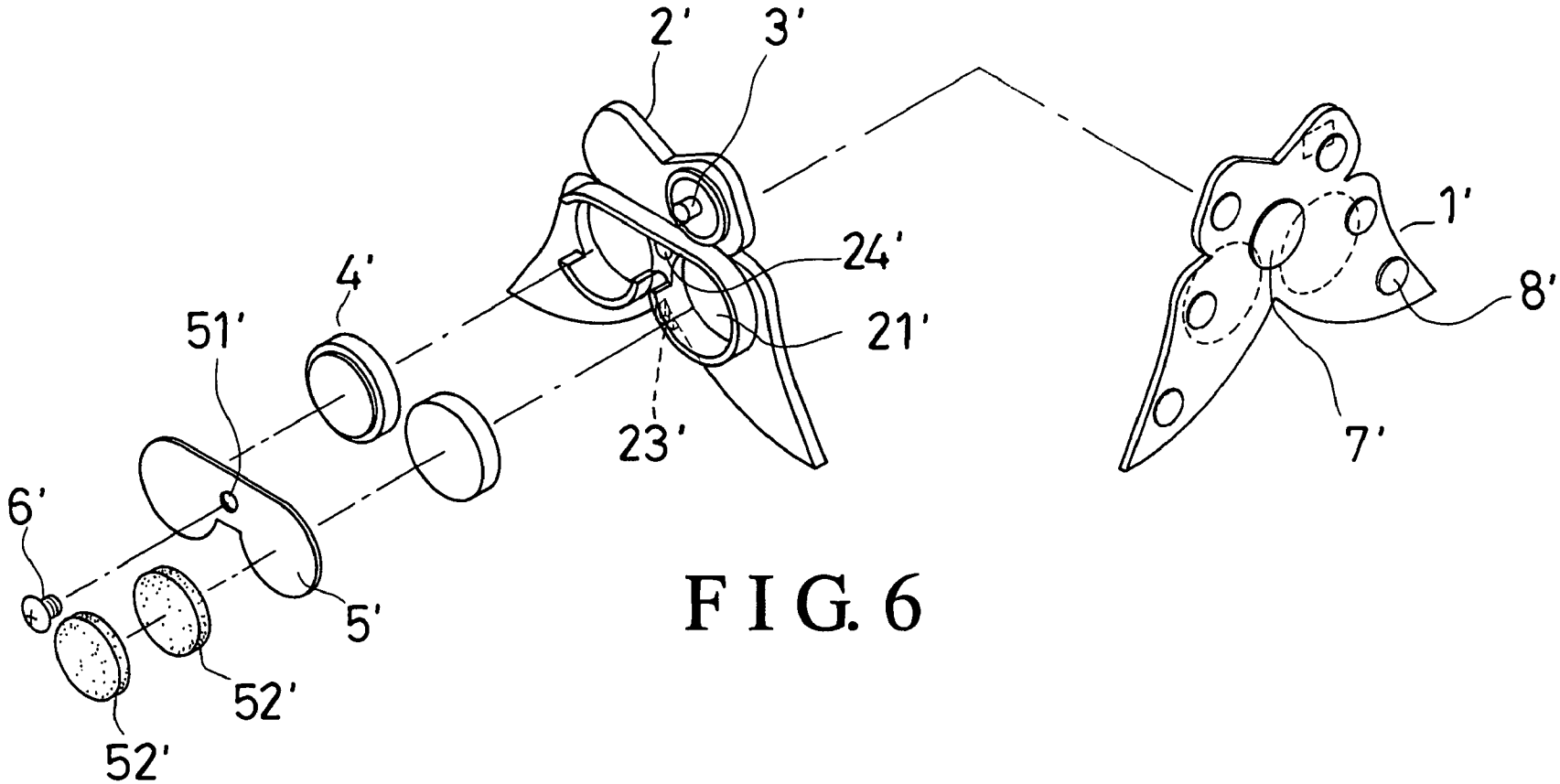
FIG. 6 is a rear view of the fourth preferred embodiment of a piece of shining costume jewelry in the present invention.

Referring to FIG. 6, an exploded perspective view of the fourth preferred embodiment of the invention, the hanging hook 23' is arranged under the holding room 21' of the battery holder 2' instead.

Figure 7:
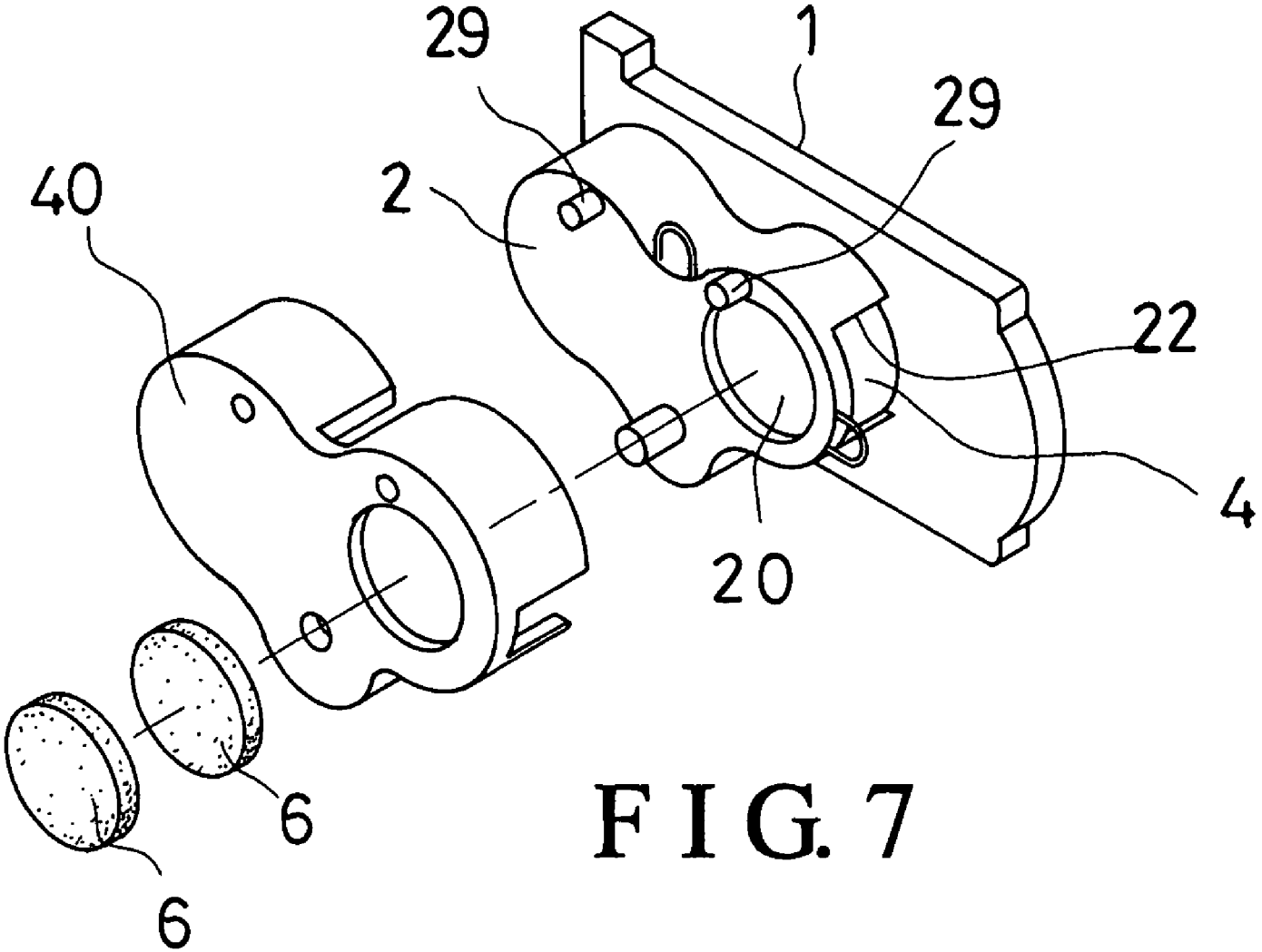
FIG. 7 is a rear view of the fifth preferred embodiment.

Referring to FIG. 7, the battery holder 2 further has a cover 40, which is securely connected to the battery holder 2, for preventing small children from taking the batteries 4 out of the jewelry.

Furthermore, the circuit boards 1, 1' can be made in various shapes, e.g. round, square, oval, star, and heart shape. From the above description, it can be understood that the jewelries of the present invention look more attractive because of the light emitted from the light emitting diodes.

What is claimed is:

1. A piece of shining costume jewelry, comprising a circuit board; the circuit board having a plurality of light emitting diodes on a front side thereof; the circuit board having an IC member thereon for controlling the light emitting diodes; the circuit board having transparent glue applied over the front side; the circuit board having a plurality of copper foils on a rear side thereof;

a battery holder secured on a rear side of the circuit board;

a plurality of batteries held in a holding room of the battery holder;

a button passed through the battery holder; and a conducting plate fitted to the battery holder to touch rear ends of the batteries;

the batteries and the button touching the copper foils of the circuit board respectively; the IC member activated to make the light emitting diodes shine by means of pressing the button against a corresponding copper foil.

2. The shining costume jewelry as claimed in claim 1, wherein the battery holder has a hanging hook secured thereto for allowing a lace to be connected thereto.

3. The shining costume jewelry as claimed in claim 2, wherein the hanging hook is higher than the conducting plate.

4. The shining costume jewelry as claimed in claim 2, wherein the hanging hook is lower than the conducting plate.

5. The shining costume jewelry as claimed in claim 1, wherein the battery holder has a safety pin secured on a rear side thereof.

6. The shining costume jewelry as claimed in claim 1, wherein the battery holder has two first through holes communicating with the holding room on left and right ends thereof the first through holes having such a size as to allow the batteries to pass through; the battery holder having a second through hole communicating with the holding room on an upper portion thereof for allowing a tool to pass through to push the batteries outside.

7. The shining costume jewelry as claimed in claim 6, wherein the battery holder has a cover positioned thereon and securely connected thereto.

8. The shining costume jewelry as claimed in claim 1, wherein the conducting plate has a fitting hole, and the battery holder has a locating protrusion in the holding room; the locating protrusion of the battery holder being passed through the fitting hole of the conducting plate.

9. The shining costume jewelry as claimed in claim 1, wherein the conducting plate has elastic plate portions projecting forwards to touch the batteries respectively.

10. The shining costume jewelry as claimed in claim 1, wherein the battery holder has a plurality of posts on a rear side thereof, and a safety pin is stuck to the posts by means of glue.

11. The shining costume jewelry as claimed in claim 1, wherein the battery holder has a recess on a rear side thereof, and a plurality of joined magnets are fitted on the recess of the battery holder and firmly stuck in position.

* * * * *